US006629774B1

(12) United States Patent
Gruendeman

(10) Patent No.: US 6,629,774 B1
(45) Date of Patent: Oct. 7, 2003

(54) STATIC MIXER NOZZLE AND ATTACHMENT ACCESSORY CONFIGURATION

(75) Inventor: Peter Earl Gruendeman, Allentown, NJ (US)

(73) Assignee: Tah Industries, Inc., Robbinsville, NJ (US)

( * ) Notice: Subject to any disclaimer, the term of this patent is extended or adjusted under 35 U.S.C. 154(b) by 425 days.

(21) Appl. No.: 09/703,760

(22) Filed: Nov. 1, 2000

Related U.S. Application Data

(63) Continuation-in-part of application No. 09/371,623, filed on Aug. 11, 1999, now abandoned.

(51) Int. Cl.[7] ..... B01F 5/06; B01F 15/02

(52) U.S. Cl. ..... 366/336; 366/189; 366/181.5; 366/181.8; 222/145.6

(58) Field of Search ..... 366/336, 130, 366/129, 189, 181.5, 181.8, 177.1, 162.3; 604/240, 416, 191; 222/137, 145.5, 145.6, 325, 326, 327, 386, 567

(56) References Cited

U.S. PATENT DOCUMENTS

| | | | | | |
|---|---|---|---|---|---|
| 2,902,995 | A | | 9/1959 | Loper | |
| 3,021,942 | A | | 2/1962 | Hamilton | |
| 3,159,312 | A | | 12/1964 | Sciver | |
| 3,245,703 | A | | 4/1966 | Manly | |
| 3,330,444 | A | * | 7/1967 | Raypholtz | 222/137 |
| 3,390,814 | A | * | 7/1968 | Creighton, Jr. et al. | 222/137 |
| 3,469,581 | A | | 9/1969 | Burke | |
| 4,040,420 | A | | 8/1977 | Speer | |
| 4,204,775 | A | | 5/1980 | Speer | |
| 4,302,113 | A | | 11/1981 | Rumfola | |
| 4,430,080 | A | | 2/1984 | Pasquini et al. | |
| 4,538,920 | A | * | 9/1985 | Drake | 366/181.5 |
| 4,753,536 | A | * | 6/1988 | Spehar et al. | 366/339 |
| 4,767,026 | A | * | 8/1988 | Keller et al. | 222/137 |
| 4,907,725 | A | | 3/1990 | Durham | |
| 4,995,540 | A | * | 2/1991 | Colin et al. | 222/145.6 |
| 5,033,650 | A | * | 7/1991 | Colin et al. | 222/137 |
| 5,053,202 | A | | 10/1991 | Dwyer et al. | |
| 5,066,286 | A | | 11/1991 | Ryan | |
| 5,069,881 | A | | 12/1991 | Clarkin | |
| 5,080,262 | A | * | 1/1992 | Herold et al. | 222/145.6 |
| 5,129,825 | A | | 7/1992 | Discko, Jr. | |
| 5,328,462 | A | | 7/1994 | Fischer | |
| 5,401,169 | A | * | 3/1995 | Fleisher et al. | 433/90 |
| 5,462,317 | A | * | 10/1995 | Keller | 222/566 |
| 5,478,150 | A | | 12/1995 | Keller et al. | |
| 5,487,606 | A | * | 1/1996 | Keller | 366/339 |
| 5,573,281 | A | * | 11/1996 | Keller | 222/566 |
| 5,609,271 | A | * | 3/1997 | Keller et al. | 222/145.6 |
| 5,611,785 | A | | 3/1997 | Mito et al. | |
| 5,624,260 | A | * | 4/1997 | Wilcox et al. | 433/90 |
| 5,819,988 | A | * | 10/1998 | Sawhney et al. | 222/137 |
| 6,065,645 | A | * | 5/2000 | Sawhney et al. | 222/137 |
| 6,186,363 | B1 | * | 2/2001 | Keller et al. | 222/145.6 |

* cited by examiner

*Primary Examiner*—Tony G. Soohoo
(74) *Attorney, Agent, or Firm*—Davis & Bujold PLLC

(57) ABSTRACT

A static mixer apparatus providing a mixer and releasably affixed dispensing accessory in which the static mixer outlet tip has a dispensing accessory mounting structure to maintain orientation of the accessory about an axis defined by the structure, the structure having a generally cylindrical accessory mounting boss coaxial with the axis and defining a dispensing outlet for mixed material from the mixer and a projection extends radially from said boss for engagement with a cooperating feature of the dispensing accessory to determine and maintain at least one desired orientation of that dispensing accessory relative to the structure about the axis. The dispensing accessory is preferably asymmetric.

12 Claims, 8 Drawing Sheets

STATIC MIXER NOZZLE AND ATTACHMENT ACCESSORY CONFIGURATION

RELATED APPLICATION

This is a continuation-in-part of U.S. application Ser. No. 09/371,623 filed Aug. 11, 1999 now abandoned.

FIELD OF THE INVENTION

The invention pertains to a nozzle of a static mixer that is configured to removably receive an attachment accessory thereon, particularly, in a desired fixed orientation.

BACKGROUND OF THE INVENTION

Static mixers for dispensing fluids such as adhesives, sealants, caulks, etc., from a multi-component dispenser often require the attachment of nozzle accessories, for example, shaped dispensers, extensions, hoses etc. These accessories are typically attached to the outlet tip of a static mixer with either an externally threaded mount which is integral with the outlet tip or by snap fitting or frictional engagement arrangements with a retaining shoulder as is well known in the art.

Existing snap on and thread on accessories are both deficient in one manner or another. Snap on accessories can be rotated to any position but have no means to retain them in any one position. Thread on accessories become secure in only one position. There is a need for a nozzle which can securely retain an attachment or accessory in a desired orientation and maintain the attachment in the desired alignment.

SUMMARY OF THE INVENTION

It is an object of the present invention to provide a outlet tip for a static mixer that is configured to secure accessories and prevent rotation or provide a desired amount of resistance to rotation in a manner such that the accessories are easily attached and detached from the nozzle and while ensuring that such attachments or accessories maintain a desired orientation with respect to the axis of the static mixer.

The desired amount of resistance to rotation depends on the type of accessory. While many variations in geometry can be designed for either of the two mating surfaces, it is in general best to keep constant the geometry of the common component, i.e. static mixer nozzle, and to vary the geometry of the accessory. For example, when an elbow or other highly asymmetrical part is to be mounted on an outlet tip, both parts must be of a highly interlocking design and provide a maximum resistance to rotation. Form tips such as a narrow fan need only a small amount of resistance to rotation. This is best accomplished by using less depth in the anti-rotation feature of the accessory while the outlet tip geometry remains consistent with a maximum depth of such an anti-rotation feature.

According to the invention there is provided a static mixer apparatus comprising a static mixer, having a static mixer element housed in an elongate tubular member terminated at an outlet tip by a dispensing assembly accessory mounting structure fast with the member, and an asymmetric dispensing accessory releasably affixed to said structure with a desired maintainable accessory orientation about an axis defined by the structure, the structure further comprising a generally cylindrical accessory mounting boss coaxial with said axis and defining the outlet tip having an outlet for mixed material from the mixer; a projection extending radially from said boss for engagement with a cooperating feature of said dispensing accessory to determine and maintain at least one said desired orientation of that accessory, relative to said structure, about said axis.

Also according to the invention there is provided a static mixer apparatus comprising a static mixer, having a static mixer element housed in an elongate tubular member terminated at an outlet tip by a dispensing assembly accessory mounting structure fast with the member, and an angled nozzle extension releasably affixed to said structure with a desired maintainable nozzle extension orientation about an axis defined by the mounting structure; (a) the mounting structure comprising a generally cylindrical extension mounting boss coaxial with said axis and defining the outlet tip having an outlet for mixed material from the mixer; and a projection extending radially from said boss for engagement with a cooperating feature of said nozzle extension to determine and maintain at least one desired orientation of that nozzle extension, relative to said structure, about said axis; and (b) the angled nozzle extension comprising a further nozzle accessory mounting structure, defining an outlet axis intersecting said axis defined by the structure, for releasably affixing a dispensing accessory to the extension with a desired maintainable orientation about said outlet axis, the further mounting structure comprising: a generally cylindrical extension mounting boss coaxial with said outlet axis and defining a dispensing outlet for mixed material from the mixer; and a projection extending radially from said extension boss for engagement with a cooperating feature of a said dispensing accessory to determine and maintain at least one desired orientation of that accessory, relative to said further structure, about said outlet axis.

Further according to the invention there is provided a static mixer apparatus comprising a static mixer, having a static mixer element housed in an elongate tubular member terminated at an outlet tip by a dispensing assembly accessory mounting structure fast with the member, an angled nozzle extension, and a dispensing accessory, the angled nozzle extension being releasably affixed to said structure with a desired maintainable nozzle extension orientation about an axis defined by the mounting structure; (a) the mounting structure comprising a generally cylindrical extension mounting boss coaxial with said axis and defining the outlet tip having an outlet for mixed material from the mixer; and a projection extending radially from said boss for engagement with a cooperating feature of said nozzle extension to determine and maintain at least one desired orientation of that nozzle extension, relative to said structure, about said axis; (b) the nozzle extension comprising a further nozzle accessory mounting structure, defining an outlet axis intersecting said axis defined by the structure, for releasably affixing a dispensing accessory to the extension with a desired maintainable orientation about said outlet axis, the further mounting structure comprising a generally cylindrical extension mounting boss coaxial with said outlet axis and defining a dispensing outlet for mixed material from the mixer; and a projection extending radially from said extension boss for engagement with a cooperating feature of a said dispensing accessory to determine and maintain at least one desired orientation of that accessory, relative to said further structure, about said outlet axis; and (c) the dispensing accessory comprising a dispensing accessory affixing structure, defining an inlet axis coaxial with the nozzle extension outlet axis when the dispensing accessory is releasably affixed thereto, the affixing structure comprising at least one further projection defining the cooperating feature, said further projection extending radially from said affixing structure to engage the projection of the nozzle extension to maintain at least one said desired orientation of the dispensing assembly about the outlet axis of the dispensing accessory.

BRIEF DESCRIPTION OF THE DRAWINGS

The invention will now be described, by way of example, with reference to the accompanying drawings, in which.

DETAILED DESCRIPTION OF THE INVENTION

Figure 1:
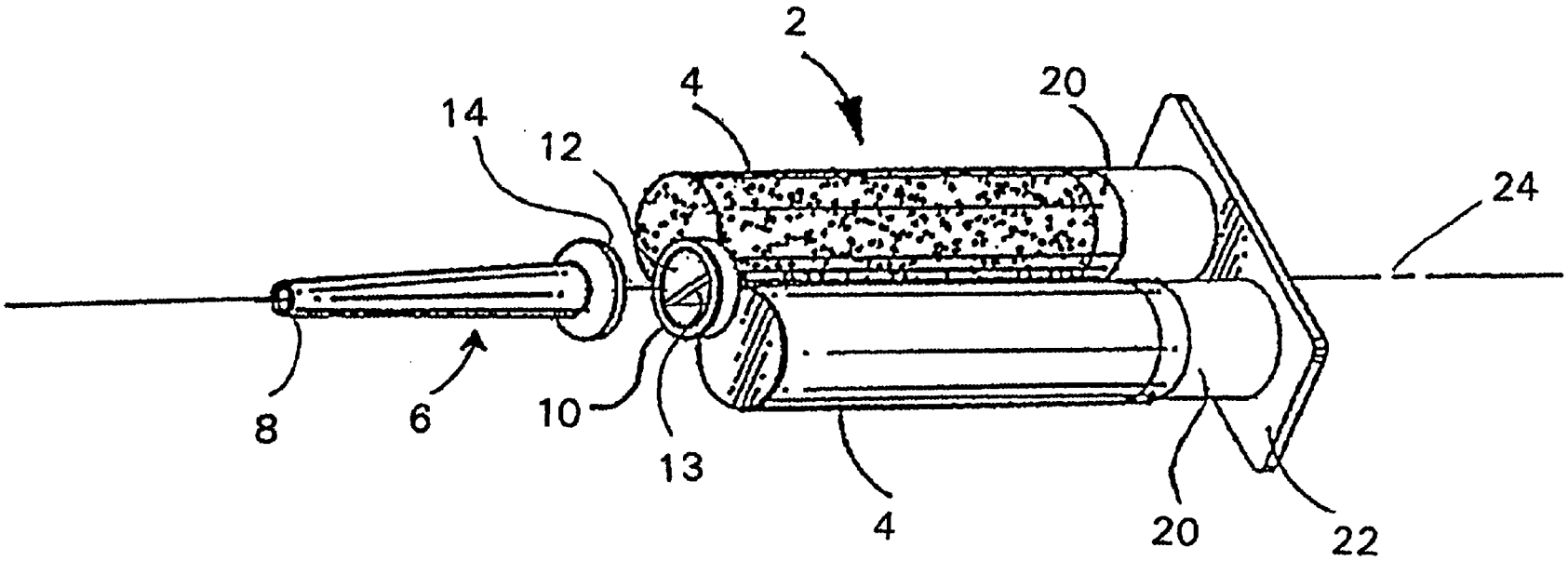
Fig. 1 PRIOR ART
FIG. 1 is a diagrammatic exploded perspective view of a double cartridge and static mixer as known in the art.
Figure 2:
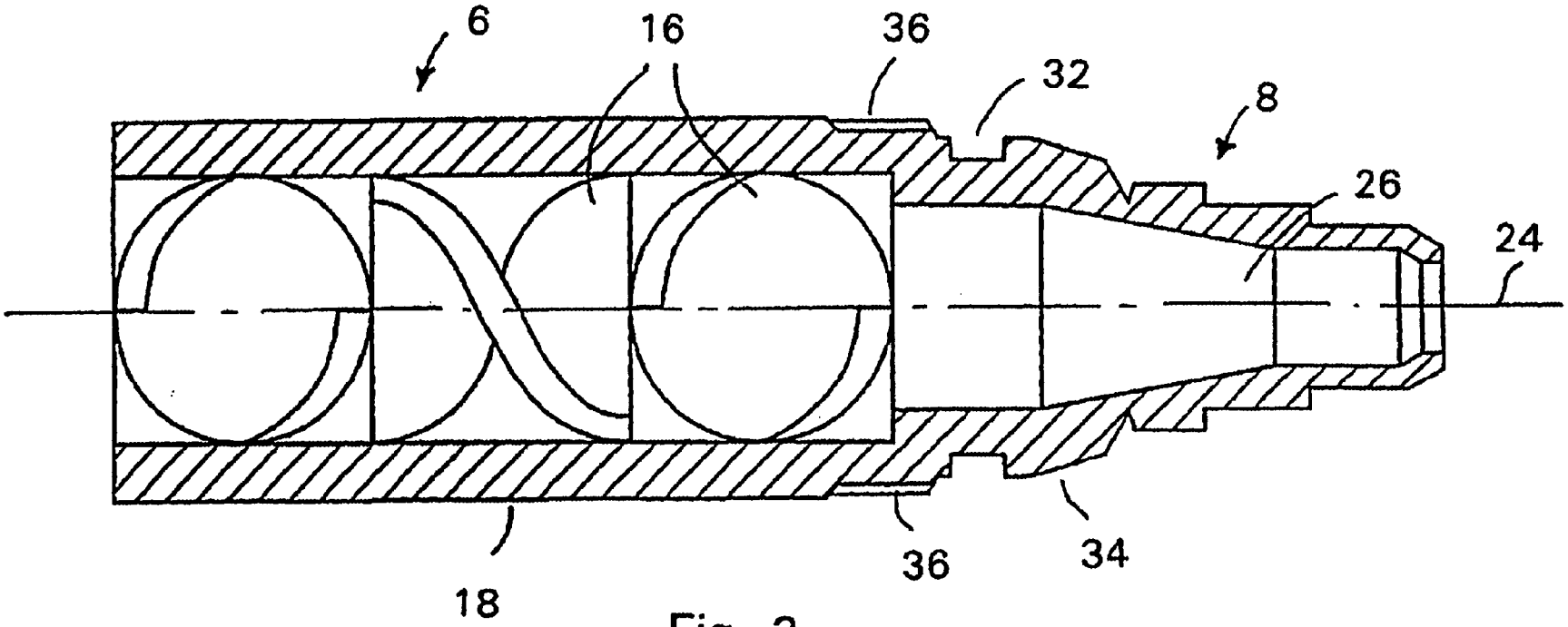
FIG. 2 is a fragmentary cross-sectional side view of the outlet tip of the present invention.

Referring firstly to the prior art as illustrated in FIG. 1 and part of FIG. 2, a double cartridge 2 comprises two parallel cylindrical containers 4 each housing one of two flowable components to be mixed when desired in a static mixer 6 which terminates in an outlet tip 8 from which the components mixed by the static mixer 6 are expelled. The static mixer 6 may be separable from and attached to the containers 4 in a manner known per se. The containers 4 which are usually of a plastics material are joined by a bridge 10 defining a tubular outlet 12 in which the two components are separated by an internal dividing wall 13 to maintain the components separate and unmixed until they reach inlet 14 of the static mixer 6 for mixing therein. In a conventional manner, the static mixer, again usually of a plastics material, comprises a static mixer element 16 housed in an elongate tubular member 18 extending from attachment to the tubular outlet 12 to outlet tip 8. Also in conventionable fashion the static mixer element comprises an axially extending serial plurality of alternating oppositely oriented helically twisted mixer blades which act in concert to efficiently and thoroughly mix the separate components as they flow through the static mixer 6 from the tubular outlet 12 to the outlet tip 8.

As is also well known in this technology, pistons 20 are operated simultaneously by a suitable mechanism (not shown) with the cartridge being retained by the back plate 22, to dispense the components simultaneously from the containers through the tubular outlet and static mixer to the outlet tip 8.

Referring now to the present invention as illustrated in FIGS. 2, 3*a*, 3*b*, 3*c*, and 4, the outlet tip 8 of the static mixer 6 has an external multi-tiered profile through which extends a longitudinal axis 24 which is coaxial with the static mixer and a dispensing outlet 26 from which the components mixed by the static mixer 6 are dispensed through a dispensing accessory 28 shaped and designed for the application involved and attached, during use, to the outlet tip 8. The dispensing accessory 28 is sized and shaped to cooperate with the outlet tip 8 for resilient support thereon in a sufficiently tight and sealed matter to prevent mixed components from leaking past the attachment arrangements. Such leakage may be prevented by a sufficiently tight connection between the outlet tip and the dispensing accessory and/or by the provision of suitable sealing means (not shown), as will be readily apparent to those skilled in the art. Resilient attachment of the dispensing accessory 28 on the outlet tip 8 is achieved by engagement of a circumferential band 30, on a cylindrical interior surface of the dispensing accessory 28, sized to engage resiliently a circumferential groove 32 formed on a cooperating outer cylindrical surface of the outlet tip 8. The resilient engagement of the band 30 and groove 32 is facilitated by the inherent resilience of the plastics material from which the outlet tip 8 and the dispensing accessory are constructed although, in fact, only one of these components needs to be resiliently deformable for the resilient connections to be made. A frusto-conical surface 34 leading to the aforementioned cylindrical surface on the outlet tip 8 facilitates alignment of the dispensing accessory 28 with the outlet tip 8 and subsequent engagement of the band 30 with the groove 32. The band 30 and groove 32 are shaped to facilitate not only engagement of the dispensing accessory 28 with the outlet tip 8, but also to allow separation of these components when desired.

Figure 3A:
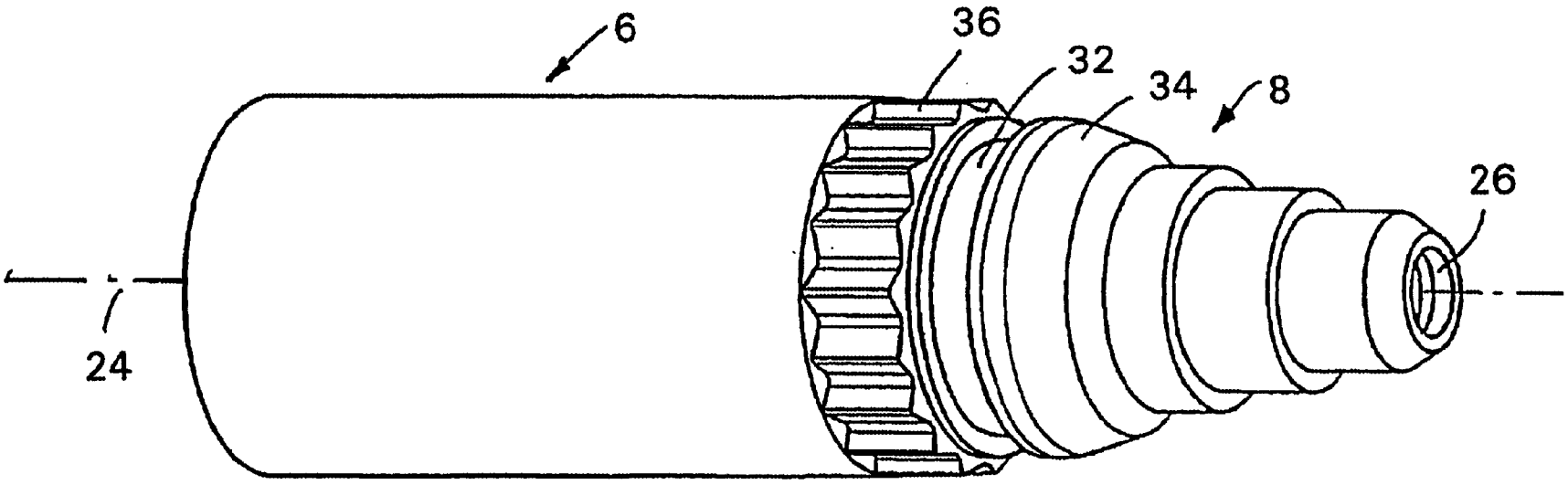
FIGS. 3*a* and 3*b* are a diagrammatic perspective view of the outlet tip and a separate dispensing accessory, respectively.
Figure 3B:
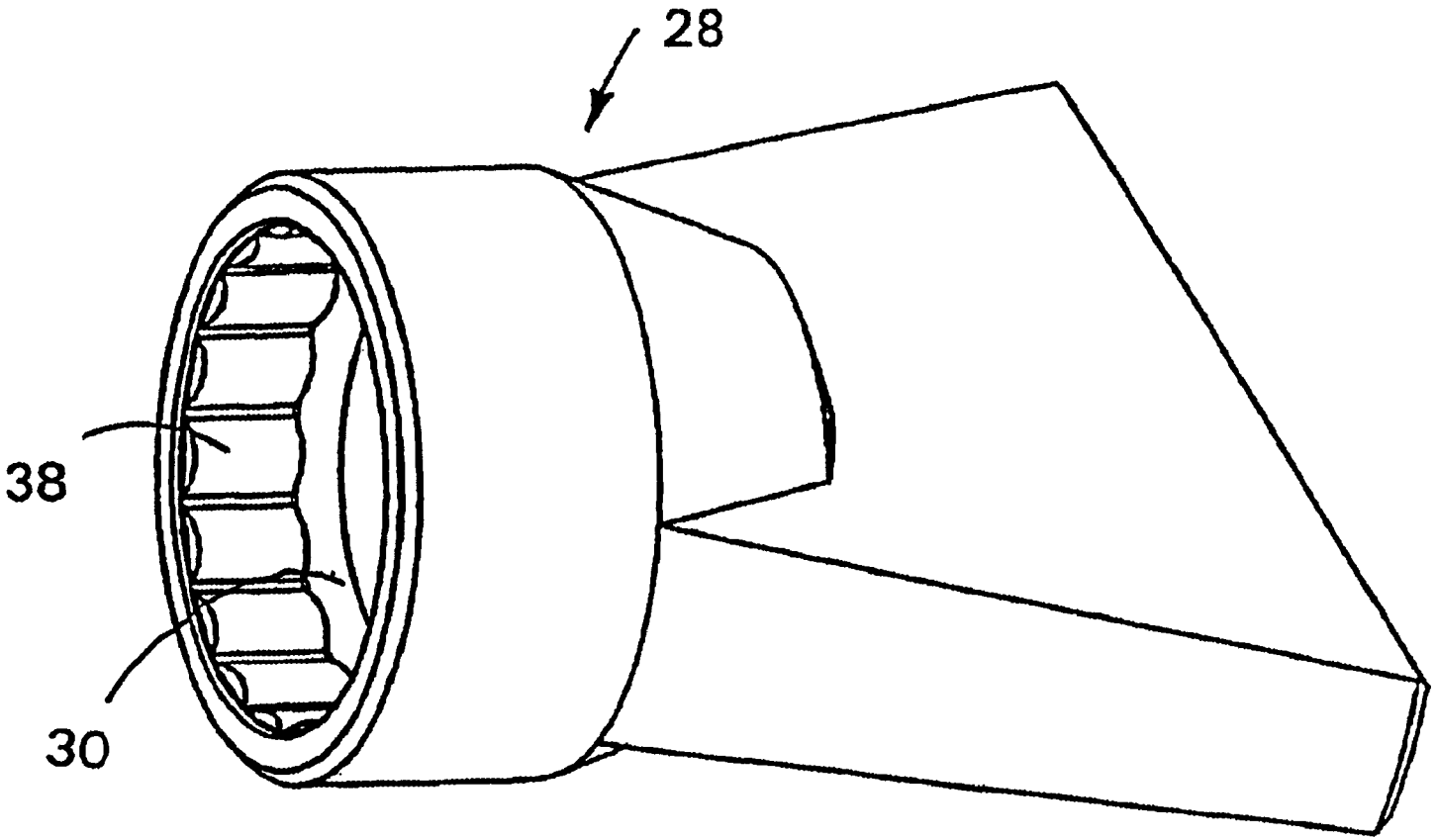
Figure 3C:
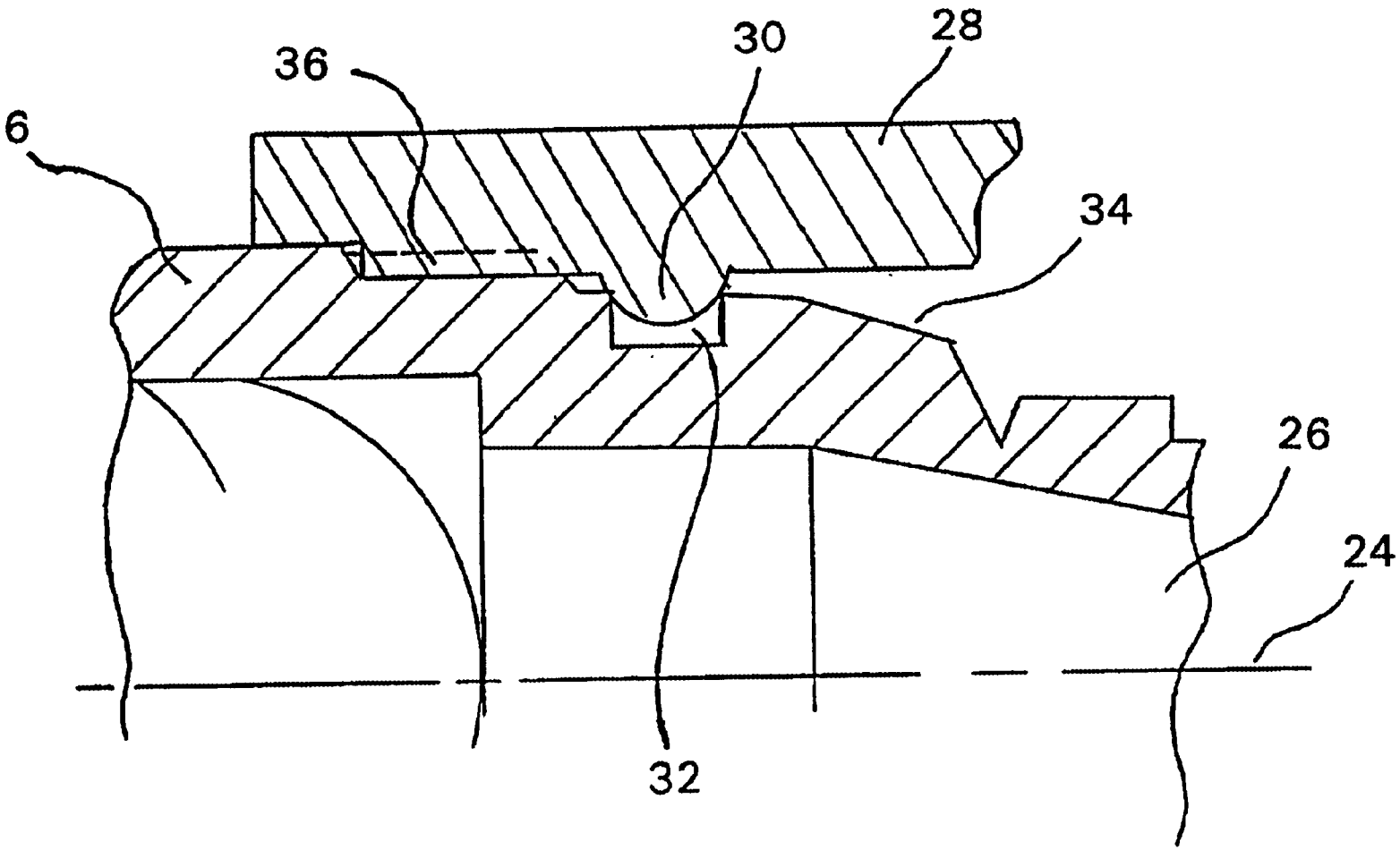
FIG. 3*c* is a fragmentary view of the accessory when mounted on the tip.

The cylindrical surface of the outlet tip is coaxial with the axis 24 and carries, fast therewith, and adjacent the groove 32, at least one rib or spline 36 extending parallel to the axis 24. As used herein, the terms rib and spline are to be considered to be interchangeable. Preferably, as shown in FIG. 3*a* and FIG. 4, there are a plurality of the ribs 36 spaced about the circumference of the aforementioned cylindrical surface of the outlet tip 8.

The interior of the dispensing accessory 28 defines at least one, preferably a plurality of ribs 38, extending parallel to the axis 24 when the dispensing accessory 28 is engaged on the outlet tip 8. At least one of the dispensing accessory 28 and outlet tip 8 have a plurality of the ribs evenly spaced with a circumferential pitch to engage the ribs of the other dispensing accessory 28 and outlet tip 8, to fixedly determine the orientation of the dispensing accessory 28 about the axis 24 when the dispensing accessory 28 engages the outlet tip 8 with the band 30 and groove 32 and the ribs of these components engaged. Of course, the band 30 and groove 32 are disposed when engaged, to ensure that simultaneously, the ribs of the dispensing accessory 28 and outlet tip 8 are also engaged. Typically the ribs 38 of the dispensing accessory are evenly spaced about the entire interior surface of the dispensing accessory while a plurality of ribs 36 are disposed on the cylindrical exterior surface of the outlet tip 8 with a pitch which is equal to or a multiple of the pitch of the ribs 38 of the dispensing 28. It should be appreciated that while the current design of outlet tip has eighteen ribs 36, as few as one rib 36 may be desirable for some applications. In any event, the ribs 36 and 38 are designed to engage one another to fixedly determine the orientation of the dispensing accessory 28 about the axis 24 relative to the outlet tip 8 in any one of a plurality of predetermined desired orientations. The fragmentary cross-section illustrated in FIG. 4 illustrates an engagement arrangement of ribs 36 and 38 which is based on interengaging polygons with pitches and dimensions to engage ribs 36 evenly spaced about the exterior of the outlet tip 8 and the entire inner periphery of the dispensing accessory 28.

Figure 5:
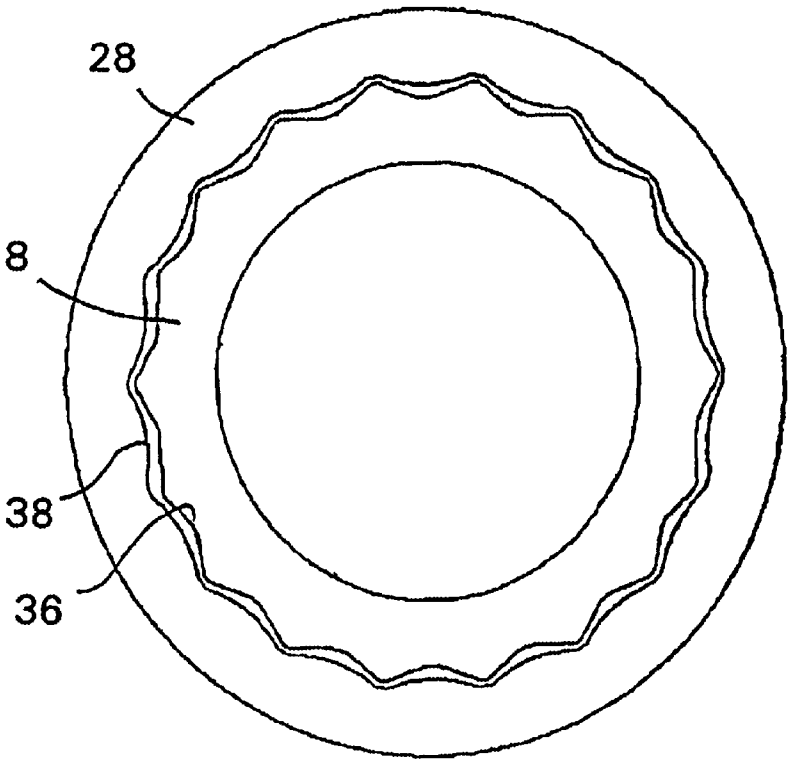
FIG. 5 is a fragmentary cross-sectional view of a yet further view of interlocking protrusions with engaging surfaces designed to provide limited interference with relative rotation of an outlet tip and dispensing accessory.
Figure 4:
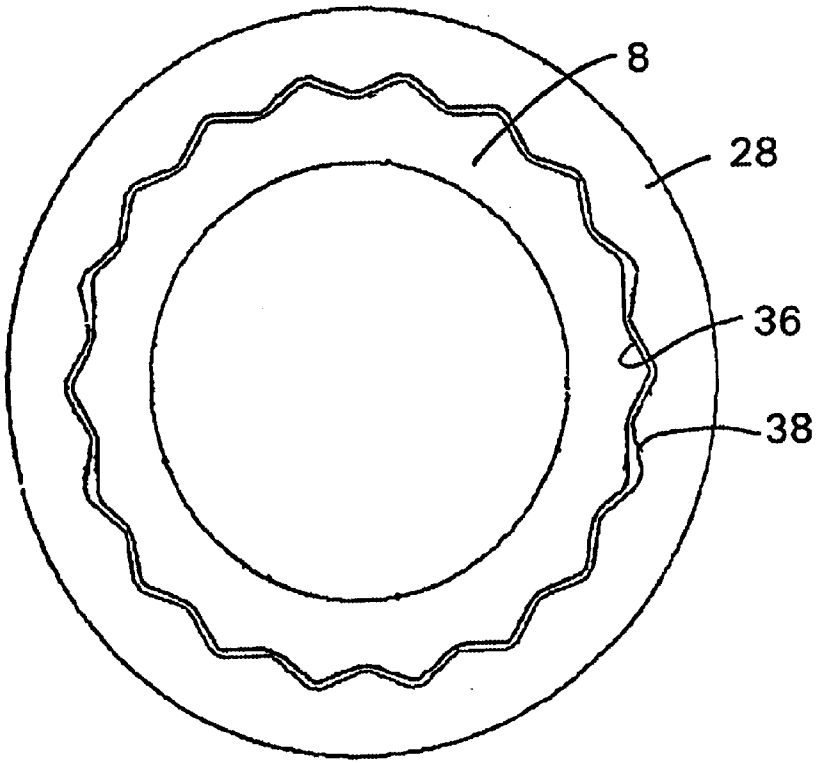
FIG. 4 is a fragmentary cross sectional view of interlocking protrusions of polygonal engaging surfaces extending from the surfaces of the outlet tip and dispensing accessory respectively, designed to provide a maximum amount of resistance to rotation.

As shown in FIG. 4, the inner polygon of the dispensing accessory 28 can be formed to substantially match the polygon ribs 36 of the outlet tip The polygons may be of disproportionate shape and size (FIG. 5) so as to enable the dispensing accessory to have a limited rotation or slip feature such that a greater or lesser amount of interference created between the ribs 36, 38 provide a desired amount of resistance to rotation. For instance, polygonal interfering surfaces and the associated ribs which are substantially similar in size and shape tend to provide a greater resistance to slip and/or rotation, whereas polygonal interfering surface which are substantially dissimilar in size allow a desired amount of slippage between the surfaces.

Figure 6:
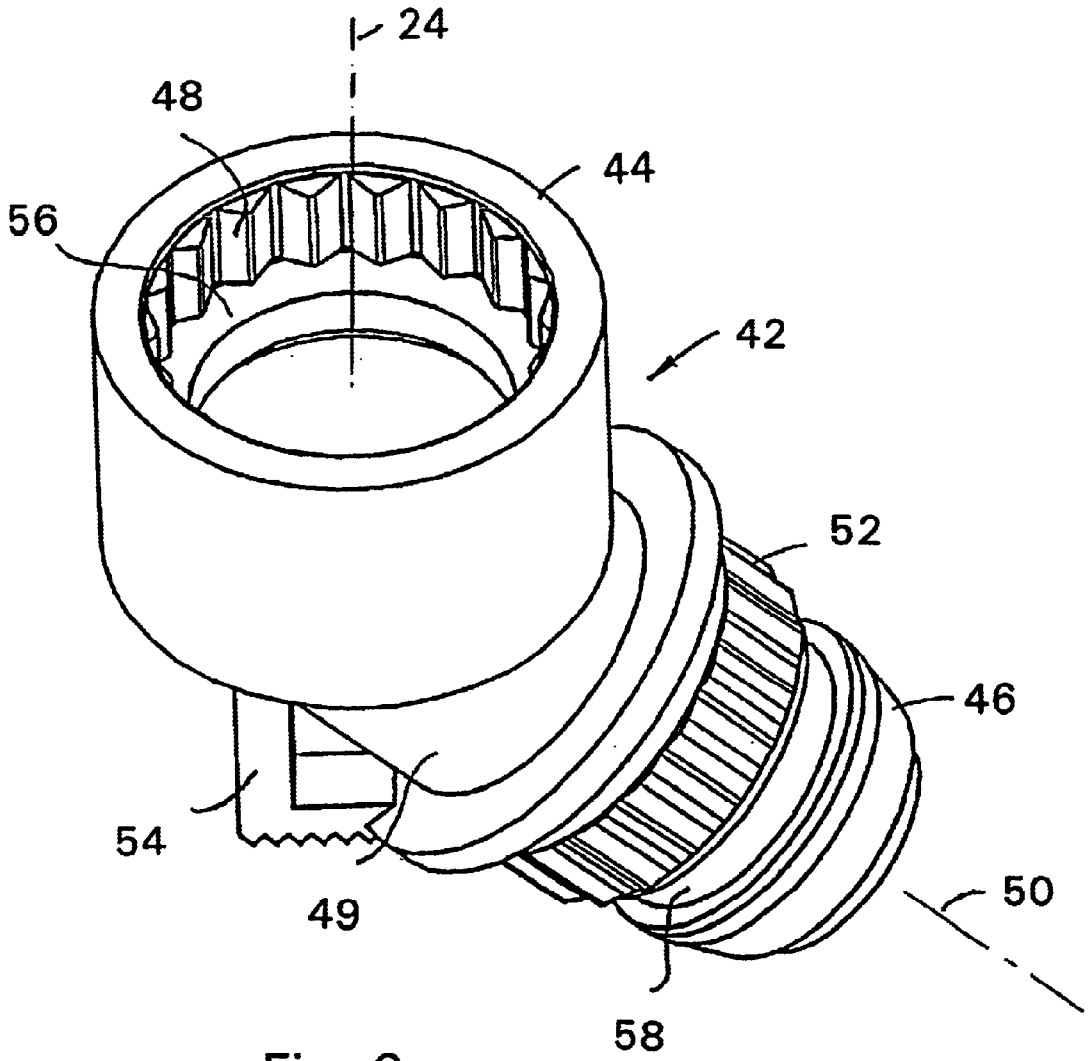
FIG. 6 is a diagrammatic perspective view of an angled nozzle extension.

Turning now to FIG. 6, an angled nozzle extension or angled intermediate accessory 42, useful for directing flow from the outlet tip 8 in a particular desired direction, is shown. The angled nozzle extension 42 includes a first end 44 defined about the axis 24 and a second end 46 defining an axis 50 intersecting the first axis 24. An interior circumferential surface of the first end 44 defines at least one and preferably a plurality of ribs 48 which extend parallel to the original axis 24 of the outlet tip 8 and are designed to lockably engage the ribs 36 of the outlet tip 8. The ribs 36, 38, 48, 52 can be shaped differently and varied in number to effect a greater or lesser amount of resistance to rotation.

A central section 49 interconnects the first end 44 and the second end 46. The second end 46 also includes at least one and preferably a plurality of engaging ribs 52 positioned parallel to axis 50, and formed externally around an outer circumferential portion of the second end 46. The ribs 52 are designed to fixedly engage the interior ribs 38 of the dispensing accessory 28 or another angled nozzle extension. The central section 49 of the angled nozzle extension 42 can include a supporting finger grip 54 adding further support for installing same on the static mixer outlet tip and additional integrity to the central section 49.

The first end 44 further includes a circumferential band 56 located adjacent to the ribs sized to resiliently engage the circumferential groove 32 of the static mixer outlet tip 8. Similarly, the second end is formed with a circumferential groove 58, formed to resiliently accept a resilient engagement band 30 of a dispensing accessory or another angled nozzle extension.

While the orienting elements of the outlet tip 8 and dispensing accessory 28 have been described as ribs or splines, it will be appreciated that one of these could be in the form of hemispherical, pyramidal, circular or other cross-section projecting buttons to achieve the same result.

Figure 7:
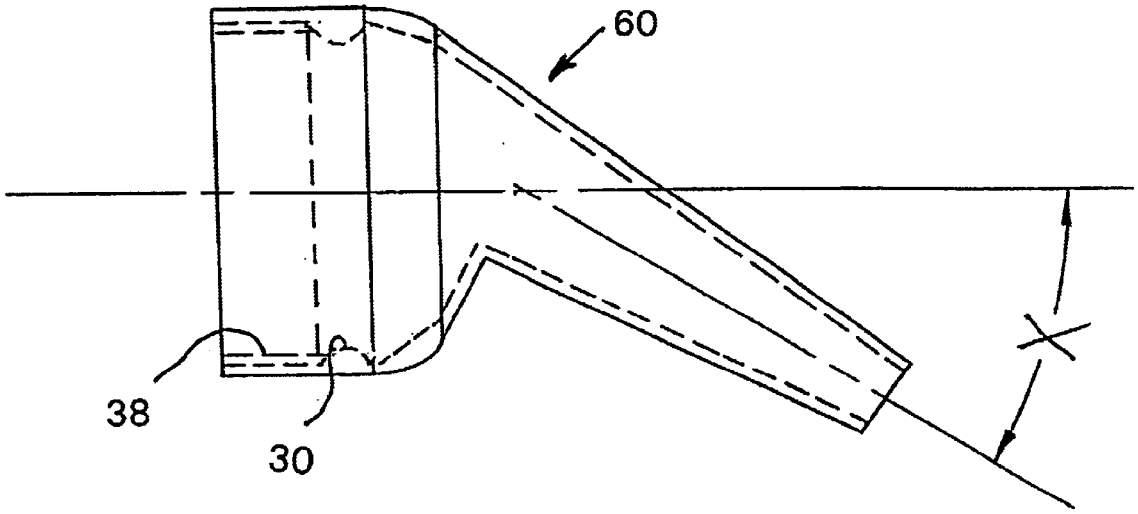
FIG. 7 is a fragmentary cross-sectional view of an asymmetric dispensing accessory.
Figure 8:
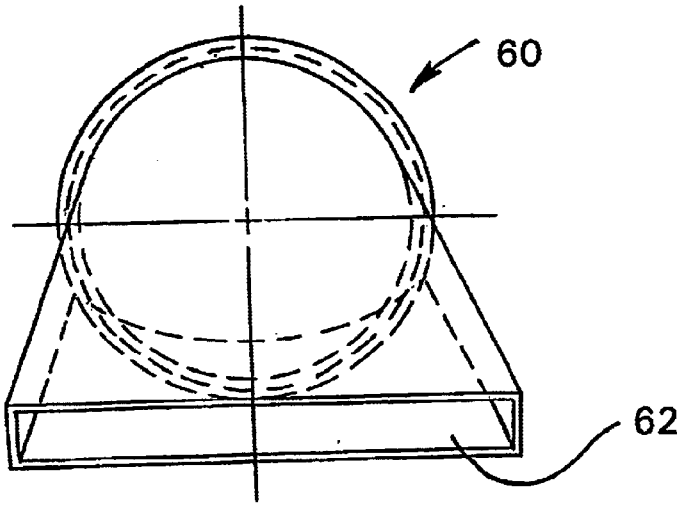
FIG. 8 is an end view of an asymmetric dispensing accessory.

FIGS. 7 and 8 refer to an asymmetric dispensing accessory 60 which can be releasably attached to the static mixer 6 and is shaped to cooperate with the outlet tip 8, using ribs 38, and circumferential band 30 similar to dispensing accessory 28. The angle X of asymmetric dispensing accessory 60 can be varied between about zero to about 90 degrees. Angle X permits the static mixer 6 to be positioned in an orientation approximately parallel to the work surface the dispensed fluid is being applied to. Asymmetric dispensing accessory 60 is shown with a wide dispensing opening 62. Opening 62 may also be provided in alternate shapes conducive to applying dispensed fluid in thin, flat shape, to a round bead, or in droplet shapes.

REFERENCE NUMERALS

2 double cartridge
4 containers
6 static mixer
8 outlet tip
10 molded bridge
12 tubular outlet
13 dividing wall
14 inlet to static mixer
16 mixer element
18 elongate tubular member
20 pistons
22 back plate
24 longitudinal axis
26 dispensing outlet
28 dispensing accessory
30 circumferential band
32 circumferential groove
34 frusto-conical surface
36 ribs
38 ribs
42 intermediate attachment
44 first end
46 second end
48 ribs
49 central section
50 axis of second end
52 ribs
54 grip
56 circumferential band
58 circumferential groove
60 asymmetric dispensing accessory
62 dispensing opening
X angle

I claim:

1. A static mixer apparatus comprising a static mixer, having a static mixer element housed in an elongate tubular member terminated at an outlet tip by a dispensing assembly accessory mounting structure fast with the member, and an asymmetric dispensing accessory releasably affixed to said structure with a desired maintainable accessory orientation about an axis defined by the structure, the structure further comprising:

a generally cylindrical accessory mounting boss coaxial with said axis and defining the outlet tip having an outlet for mixed material from the mixer;

a projection extending radially from said boss for engagement with a cooperating feature of said dispensing accessory to determine and maintain at least one said desired orientation of that accessory, relative to said structure, about said axis.

2. The apparatus of claim 1, wherein said projection and said cooperating feature determine and maintain any one of a plurality of desired orientations.

3. The apparatus of claim 2, wherein said projection is one of a plurality of circumferential evenly spaced elongate ribs extending parallel to said axis.

4. The apparatus of claim 2 comprising a circumferential feature of said boss for resilient engagement with a cooperating feature of a said accessory to removably resiliently engage said boss.

5. The apparatus of claim 4, wherein the circumferential feature and cooperating feature are a circumferential groove and band respectively.

6. A static mixer apparatus comprising a static mixer, having a static mixer element housed in an elongate tubular member terminated at an outlet tip by a dispensing assembly accessory mounting structure fast with the member, and an angled nozzle extension releasably affixed to said structure with a desired maintainable nozzle extension orientation about an axis defined by the mounting structure;

(a) the mounting structure comprising:

a generally cylindrical extension mounting boss coaxial with said axis and defining the outlet tip having an outlet for mixed material from the mixer; and a projection extending radially from said boss for engagement with a cooperating feature of said nozzle extension to determine and maintain at least one desired orientation of that nozzle extension, relative to said structure, about said axis; and (b) the angled nozzle extension comprising:

a further nozzle accessory mounting structure, defining an outlet axis intersecting said axis defined by the structure, for releasably affixing a dispensing accessory to the extension with a desired maintainable orientation about said outlet axis, the further mounting structure comprising:

a generally cylindrical extension mounting boss coaxial with said outlet axis and defining a dispensing outlet for mixed material from the mixer; and a projection extending radially from said extension boss for engagement with a cooperating feature of a said dispensing accessory to determine and maintain at least one desired orientation of that accessory, relative to said further structure, about said outlet axis.

7. A static mixer apparatus comprising a static mixer, having a static mixer element housed in an elongate tubular member terminated at an outlet tip by a dispensing assembly accessory mounting structure fast with the member, an angled nozzle extension, and a dispensing accessory, the angled nozzle extension being releasably affixed to said structure with a desired maintainable nozzle extension orientation about an axis defined by the mounting structure;

(a) the mounting structure comprising:

a generally cylindrical extension mounting boss coaxial with said axis and defining the outlet tip having an outlet for mixed material from the mixer; and a projection extending radially from said boss for engagement with a cooperating feature of said nozzle extension to determine and maintain at least one desired orientation of that nozzle extension, relative to said structure, about said axis;

(b) the nozzle extension comprising:

a further nozzle accessory mounting structure, defining an outlet axis intersecting said axis defined by the structure, for releasably affixing a dispensing accessory to the extension with a desired maintainable orientation about said outlet axis, the further mounting structure comprising:

a generally cylindrical extension mounting boss coaxial with said outlet axis and defining a dispensing outlet for mixed material from the mixer; and a projection extending radially from said extension boss for engagement with a cooperating feature of a said dispensing accessory to determine and maintain at least one desired orientation of that accessory, relative to said further structure, about said outlet axis; and (c) the dispensing accessory comprising:

a dispensing accessory affixing structure, defining an inlet axis coaxial with the nozzle extension outlet axis when the dispensing accessory is releasably affixed thereto, the affixing structure comprising:

at least one further projection defining the cooperating feature, said further projection extending radially from said affixing structure to engage the projection of the nozzle extension to maintain at least one said desired orientation of the dispensing assembly about the outlet axis of the dispensing accessory.

8. The apparatus of claim 7, wherein said projection and said cooperating feature determine and maintain any one of a plurality of desired orientations.

9. The apparatus of claim 8, wherein said projection is one of a plurality of circumferential evenly spaced elongate ribs extending parallel to said axis and said cooperating feature is a plurality of circumferentially evenly spaced elongate ribs disposed on an interior periphery of the dispensing accessory.

10. The apparatus of claim 8 comprising a circumferential feature of said boss for resilient engagement with a cooperating feature of the dispensing accessory to removably resiliently maintain that dispensing accessory in engagement with said boss.

11. The apparatus of claim 10, wherein the circumferential feature and cooperating feature are a circumferential groove and band respectively.

12. The apparatus of claim 7, wherein the dispensing accessory is asymmetric.

* * * * *